US005221104A

United States Patent [19]

Bejean et al.

[11] Patent Number: 5,221,104

[45] Date of Patent: Jun. 22, 1993

[54] DEVICE FOR PREVENTING BACKWARD SLIPPAGE OF CROSS-COUNTRY SKI

[75] Inventors: Alain Bejean, Alby sur Cheran; Jacques Milloz, Albens, both of France

[73] Assignee: Salomon S.A., Chavanod, France

[21] Appl. No.: 589,540

[22] Filed: Sep. 28, 1990

[30] Foreign Application Priority Data

Sep. 28, 1989 [FR] France ..... 89 12710

[51] Int. Cl.[5] ..... A63C 5/044; A63C 5/06

[52] U.S. Cl. ..... 280/604; 280/609

[58] Field of Search ..... 280/604, 608, 609, 11.18, 280/11.21, 28.11; 188/8

[56] References Cited

U.S. PATENT DOCUMENTS

| | | | |
|---|---|---|---|
| 476,572 | 6/1892 | Stone | 280/604 |
| 2,248,008 | 7/1941 | Miesen | 280/604 |
| 2,844,380 | 7/1958 | Tribelhorn | 280/604 |
| 4,148,500 | 4/1979 | Nidecker | 280/604 |
| 4,674,764 | 6/1987 | Miesen | 280/604 |

FOREIGN PATENT DOCUMENTS

| | | | |
|---|---|---|---|
| 2615196 | 10/1976 | Fed. Rep. of Germany | 280/604 |
| 2949688 | 6/1981 | Fed. Rep. of Germany | 280/604 |
| 212132 | 2/1941 | Switzerland | 280/604 |
| 234813 | 2/1945 | Switzerland | 280/604 |
| 340748 | 10/1959 | Switzerland | 280/604 |

*Primary Examiner*—Brian Johnson

*Attorney, Agent, or Firm*—Pollock, Vande Sande & Priddy

[57] ABSTRACT

A backward slippage-prevention device for cross-country skis incorporating a movable anchoring mechanism (6) mounted in a housing (4) opening into the lower sole (3) of the ski. The anchoring mechanism (6) has at least one upper surface (**6*d*) which forms an upward and rearward sloping ramp, and which is maintained in contact with at least one activating element (4*d*) fitted on the upper part of the housing (4) and capable of sliding longitudinally on the upper surface (6*d*) constituting the inclined ramp. Longitudinal play is provided between the housing (4) and the anchoring mechanism (6**).

12 Claims, 5 Drawing Sheets

DEVICE FOR PREVENTING BACKWARD SLIPPAGE OF CROSS-COUNTRY SKI

FIELD OF THE INVENTION

The present invention relates to a device for preventing backward slippage of cross-country skis.

BACKGROUND OF THE INVENTION

When the cross-country skier travels forward in a direct path, the skier rests for support alternately on each of his skis and exerts a thrusting movement forward while supporting himself on one of the skis, so as to cause the other ski to slide forward. During the performance of this alternating step, it is necessary to prevent the ski on which the skier supports himself from sliding backward, in order to ensure that the forward motion achieves maximum intensity.

Various devices preventing backward slippage of cross-country skis, while permitting its forward sliding motion with the minimum possible friction, are already known. For this purpose, a ski wax may be used to coat the sole of the ski and to ensure that this sole bites into the snow when a backward thrust is exerted on the ski, while reducing to a minimum the friction caused by the forward sliding of the ski. The ski wax is generally the most widely used backward slippage-inhibiting agent, but the delicacy required for its application and the inconvenience of its use are disadvantages. Indeed, waxing, which must occur before each skiing session, takes some time and is a delicate operation, since the wax must be changed when the quality of the snow varies. For this reason, other devices preventing backward slippage and incorporating mechanical anchoring mechanisms have been designed. So-called "scale"-type cross-country skis are today well known, in which the soles are shaped so as to embody, at least in the area of the ski runner, i.e., where the pressure of the skier's foot is exerted, a series of scales which, like "fish scales," are distributed over at least one part of the width and length of the ski, and which project slightly from the plane of the sole. The scales are arranged in inclined planes from top to bottom and from front to back so as to constitute, at their rear extremities, biting surfaces substantially perpendicular to the sole of the ski. Skis embodying scales thus provide for the effective anchoring of the ski in the snow during the forward thrusting motion, but they have one major disadvantage: the scales projecting beneath the sole increase considerably the friction of that sole on the snow during the forward sliding motion.

To remedy this problem, inventors have also considered equipping a cross-country ski with anchoring devices or movable "scales" mounted in a recess formed in the ski and opening into the sole of the latter. All of these "scales" are articulated around individual transverse axes and are attached to each other, while being distributed longitudinally, at a distance from one another. These movable scales may occupy a first anchoring position in the snow, in which all of the scales project downward under the sole of the ski and a second retracted position in which all of the scales are withdrawn into their recesses. In this device, because the scales are set at a distance from each other, there are gaps between them in which snow may become embedded. This snow may then hinder the operation of the backward slippage-prevention device by preventing the scales from pivoting freely. Furthermore, such a device has a relatively complex, burdensome structure because each scale can pivot around an individual transverse axis.

SUMMARY OF THE DISCLOSURE

The present invention represents an attempt to remedy these difficulties by providing a backward slippage-prevention device whose design is especially simple and which prevents any penetration of snow in the recess containing the anchoring device.

For this purpose, the backward slippage-prevention device for cross-country skis, embodying a movable anchoring mechanism mounted in a recess formed in the ski and opening into the lower sole of the latter, this anchoring mechanism being capable of occupying a first anchoring position in the snow when the ski is subjected to backward thrust and in which its lower part projects downward beneath the ski sole, so as to be held immobile in the snow or, when the ski slides forward, a second retracted position in which the lower part of the anchoring mechanism is withdrawn into its housing. The anchoring mechanism has at least one upper surface forming an inclined ramp sloping upward and rearward. Means are provided to hold the, or each, upper, inclined ramp-forming surface of the anchoring mechanism in contact with at least one activating component provided on the upper part of the housing and capable of sliding longitudinally on the, or each, upper, inclined ramp-forming surface, and longitudinal play is provided between the housing and the anchoring mechanism so as to allow slight relative longitudinal displacement of the ski and of its housing in relation to the anchoring mechanism.

BRIEF DESCRIPTION OF THE DRAWINGS

Several embodiments of the present invention will be described below with reference to the attached drawings in which.

DESCRIPTION OF THE PREFERRED EMBODIMENTS

Figure 1:
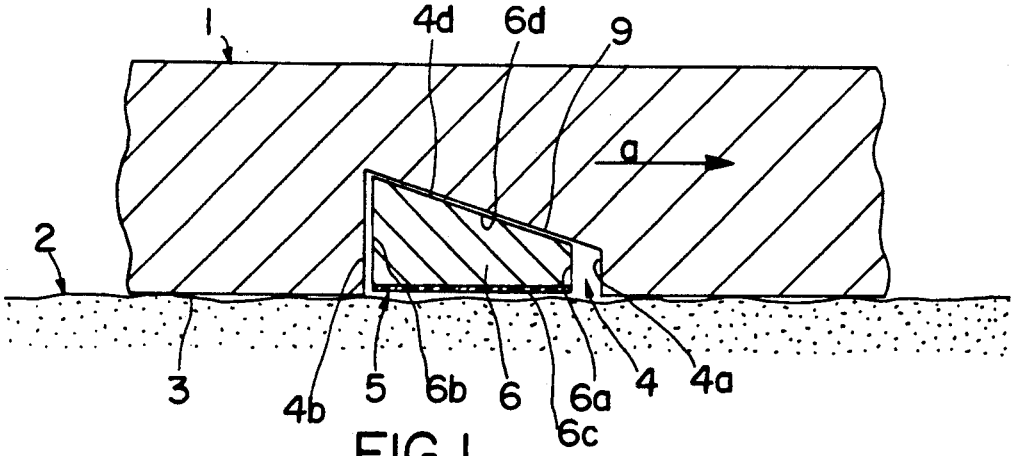
FIGS. 1, 1A, and 1B are partial schematic vertical and longitudinal section views of a cross-country ski equipped with a backward slippage-prevention device according to the invention, the anchoring mechanism of this device being represented, respectively, in the retracted position in the housing during the forward sliding motion of the ski, in the friction-generating position of contact on the snow when vertical pressure is exerted on the ski, and in the anchoring position in the snow when backward thrust is exerted on the ski.
Figure 1A:
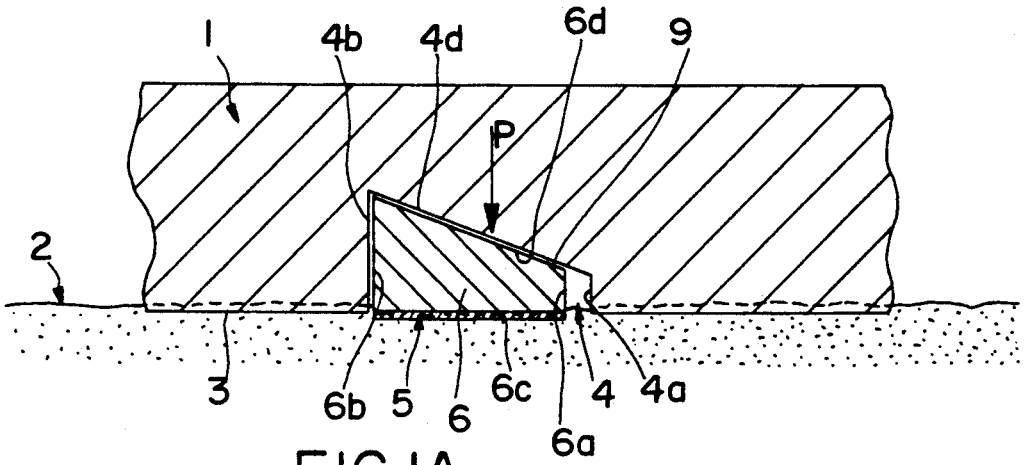
Figure 1B:
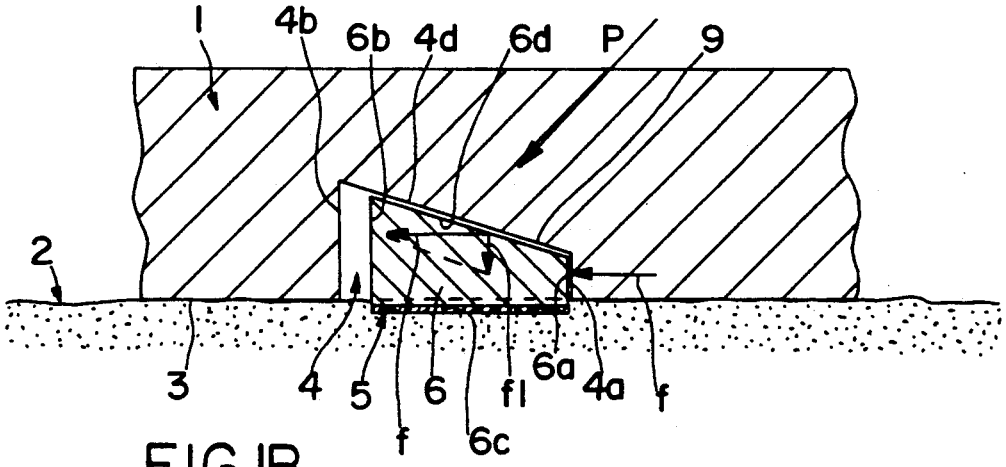

FIGS. 1A, 1B, and 1C are schematic illustrations of the principle applied in the backward slippage-prevention device for a cross-country ski according to the invention. These figures partially illustrate a cross-country ski 1 which slides on a layer of snow 2 by means of a sole 3. During the practice of the "alternating step" in cross-country skiing, the ski 1 attached to one of the skier's boots slides from left to right (in the direction of arrow a), as shown in FIG. 1 during one-half of the "alternating step." The ski is then immobilized on the snow, as shown in FIGS. 1A and 1B, serving as an immovable point of support during the other half of the "alternating step," so as to enable the skier to thrust his other ski forward. A longitudinal housing 4 opening into the plane of the sole 3 and containing the actual backward slippage-prevention device 5 is formed in the part of the ski located preferably beneath the zone of support of the ski boot (not shown). This device 5 comprises an anchoring mechanism which, viewed in vertical and longitudinal section, has the overall shape of a right-angle trapezoid whose small base is contained in the anterior frontal surface 6*a* of the anchoring mechanism 6 and whose large base is contained in its rear frontal surface 6*b*. The anterior frontal surface 6*a* is normally located at a distance from the anterior frontal surface 4*a* of the housing 4, so that slight longitudinal play is provided in the housing 4 to the front of the anchoring mechanism 6. The rear frontal surface 6*b* of the anchoring mechanism is located against the rear frontal surface 4*b* of the housing 4 or at a slight distance from the latter. In this way, the housing 4 is a little longer than the anchoring mechanism 6. Furthermore, the anchoring mechanism 6 has one lower horizontal surface 6*c* shaped so as to provide the greatest possible adhesion to the surface of the snow layer. This lower horizontal surface 6*c* may, for example, be covered with a piece of sealskin, or it may possess suitable roughness or coarseness. The anchoring mechanism 6 also has an upper surface 6*d* forming a ramp sloping upward and rearward, i.e., from right to left in FIGS. 1, 1A, and 1B. The upper sloping ramp 6*d* cooperates with an activating element which, in the example shown, is composed of the upper inclined surface 4*d* delimiting the upper portion of the housing 4 and which has the same inclination as the ramp 6*d*. Means are provided to hold the anchoring mechanism 6, by its inclined upper ramp 6*d*, pressed against the upper surface 4*d* of the housing 4. These means are not shown in the schematic FIGS. 1, 1A, and 1B, and certain embodiments of these means will be described below with reference to FIGS. 2 to 10.

The operation of the backward slippage-prevention device 5 according to the invention will now be described. During cross-country skiing, when the skier causes his ski 1 to slide forward on the snow layer 2 (this motion is illustrated by arrow a in FIG. 1), the anchoring mechanism 6 is completely retracted inside the housing 4 when acted on by the return means provided for this purpose, so that its lower surface 6*c*, which is then retracted in the housing 4, is not pressed against the upper surface of the snow layer 2. As a result, the coefficient of friction in the area of the backward slippage-prevention device 5 is reduced to a minimum.

After the forward sliding phase, the skier stops his ski 1 and begins to lean on it for support in order to be able to thrust his other ski forward. He first exerts a vertical pressure downward on ski 1, as shown by arrow p in FIG. 1A. This has the effect of embedding the ski 1 slightly in the snow, so that the lower surface 6*c* of the anchoring mechanism 6 comes into contact, by means of a slight pressure, with the surface of the snow layer 2 to which it then lightly adheres because of friction. Next, the skier gradually transforms the vertical pressure p he exerts into a thrust P downward and rearward, as illustrated by the arrow in FIG. 1B. This thrust gives rise, at the site of contact of the inclined surfaces 6*d* of the anchoring mechanism 6 and 4*d* of the housing 4, to the generation of a horizontal thrust component f directed rearward and to a component of force fl directed vertically and downward. Because of the play between the anterior frontal surfaces 4*a* of the housing 4 and 6*a* of the anchoring mechanism 6, the ski 1 and thus the housing 4 may move rearward slightly in relation to the anchoring mechanism 6, which is held immobilized as a result of slight friction of its lower surface 6*c* on the snow. The upper inclined surface 4*d* of the housing 4 is thus displaced slightly rearward in relation to the upper inclined ramp 6*d* of the anchoring mechanism 6 with which it is in contact, and this causes the anchoring mechanism 6 to move downward, so that, when acted upon by the strong pressure caused by the vertical component of force fl, the lower adherent surface 6c of the anchoring mechanism 6 is pressed against the surface of the snow layer 2. Because of these adhesion properties, this lower surface 6*c* comes to a firm stop in the snow 2 and the anchoring mechanism 6 at this point constitutes a stop engaged and immobilized in the snow. At the end of the slight rearward sliding movement of the ski 1 in relation to the anchoring mechanism 6, the anterior frontal surface 4*a* of the housing 4 becomes pressed against the anterior frontal surface 6*a* of the anchoring mechanism 6, which is then firmly stopped. In this way, this anchoring mechanism 6 opposes any additional rearward movement of the ski 1. The skier may thus gain support from his ski, whose rearward motion is blocked, thereby enabling him to thrust his other ski forward.

When, after having slid his other ski forward, the skier leans for support on this ski with his other foot and begins to exert rearward thrust, he ceases to exert thrust P on the previously stopped ski. For this reason, the anchoring mechanism 6 is no longer subjected to the strong pressure resulting from the vertical component of force fl. When the skier then thrusts his first ski forward again, the latter moves longitudinally forward in relation to the anchoring mechanism 6, this motion being made possible by the play then existing between the rear frontal surfaces 4*b* of the housing 4 and 6*b* of the anchoring mechanism 6. The upper part of the anchoring mechanism 6 is then released, as a result of the forward movement of the inclined upper surface 4*d* of the housing 4, so that the anchoring mechanism 6 can be raised within the housing 4 by the return means in order to occupy its retracted position (shown in FIG. 1) in which its lower surface 6*c* is retracted in relation to the plane of the sole 3 of the ski 1.

A special embodiment of the backward slippage-prevention device according to the invention will now be described with particular reference to FIGS. 2 to 7. In this embodiment, the backward slippage-prevention device comprises an anchoring mechanism 7 comprising a longitudinally-elongated bar in the general shape of a parallelepiped and whose lower horizontal surface is in contact with a flexible, elastic diaphragm 8 which, on its lower surface, has snow-adherence properties and which may be made, for example, of sealskin. This flexible diaphragm 8 extends beneath the entire length of the bar 7 and is anchored by its two end pieces 8*a* and 8*b* in the housing 4. The anchoring is provided by wedging the end pieces 8*a* and 8*b* of the diaphragm 8 between the rear frontal surface 4*b* and the anterior frontal surface 4*a* of the housing 4, on the one hand, and two blocks 9 and 11 set respectively in the two upper angles of the housing, on the other. The rear angle block 9 is placed against the rear frontal surface 4*b* of the housing 4 in the upper, rear angle of this housing. It comprises at that spot a lower transverse rib 9*a* which ends in a lower surface 9*b* inclined upward and rearward. This lower inclined surface 9*b* is located a little above the plane of the sole 3 of the ski and is positioned opposite a recess 12 formed in the central part of the sole 3 of the ski and whose upper surface extends between the sole 3 and the rear frontal surface 4*b* of the housing, and is thus inclined upward and forward. In the retracted position of the anchoring bar 7 inside housing 4, the end piece 8*a* of the diaphragm 8 clamped, at its upper part, between the rear frontal surface 4*b* of the housing 4 and the rear angle block 9, extends perpendicularly downward over a short distance beneath the lower inclined surface 9*b*, and it curves forward so as to form the horizontal section of the diaphragm set under the anchoring bar 7.

The rear angle block 9 also incorporates, in its front part, a downward-projecting surface 9*c* which slopes upward and rearward and which constitutes a ramp cooperating with an upper surface 7*a* of the longitudinal bar 7, this surface having the same inclination. This upper inclined surface 7*a* constitutes the lower part of a recess provided in the upper part of the longitudinal bar 7 and in which the front end piece of the rear angle block 9 is engaged.

The longitudinal anchoring bar 7 also incorporates, in its upper surface and substantially in its median part, another recess bounded by an inclined surface 7*b* forming a ramp. An intermediate block 13, attached to the upper horizontal surface 4*d* of the housing 4 and ending in a lower inclined surface 13*a*, fits into this block. The inclined surfaces 7*b* and 13*a*, which come into contact with each other, have the same slope as inclined surfaces 7*a* and 9*c*.

The forward angle block 11 is produced in substantially the same way as the rear angle block 9, and it comprises a lower front rib 11*a* pressed against the anterior frontal surface 4*a* of the housing 4, clamping between them the front end piece 8*b* of the diaphragm 8. The front angle block 11 also incorporates, in its rear part, a downwardly projecting sloping surface 11*c* which is engaged in a corresponding recess provided in the front part of the upper surface of the anchoring bar 7, this recess being bounded by a sloping surface 7*c*. The inclined surfaces 7*c* and 11*c* have the same slope as the other inclined surfaces cooperating with each other, i.e., surfaces 7*a* and 9*c* and surfaces 7*b* and 13*a*.

The backward slippage-prevention device further comprises means which limit the admissible vertical downward travel of the anchoring bar 7. These means 14 are constituted by vertical rods passing through holes drilled in the anchoring bar 7, whose upper ends are attached to the upper surface 4*d* of the housing 4 and whose lower ends are unitary with the heads 15 set in recesses 16 provided in the lower horizontal surface of the anchoring bar 7. The height of the recesses 16 is greater than the thickness of the heads 15, in order to enable the anchoring bar 7 to move downward until the upper limits of the recesses 16 come into contact with the heads 15 attached to the lower ends of the rods 14.

The rear angle block 9, the intermediate block 13, and the forward angle block 11 may be made up of individual blocks attached by any appropriate means to the upper horizontal surface 4*d* of the housing 4. According to one variant, they may be connected to each other so as to constitute a common control bar, the entirety of which is attached to the upper horizontal surface 4*d* of the housing 4. In this last case, the means 14 limiting the vertical travel of the anchoring bar 7 may advantageously be attached to this upper, common control bar.

Figure 2:
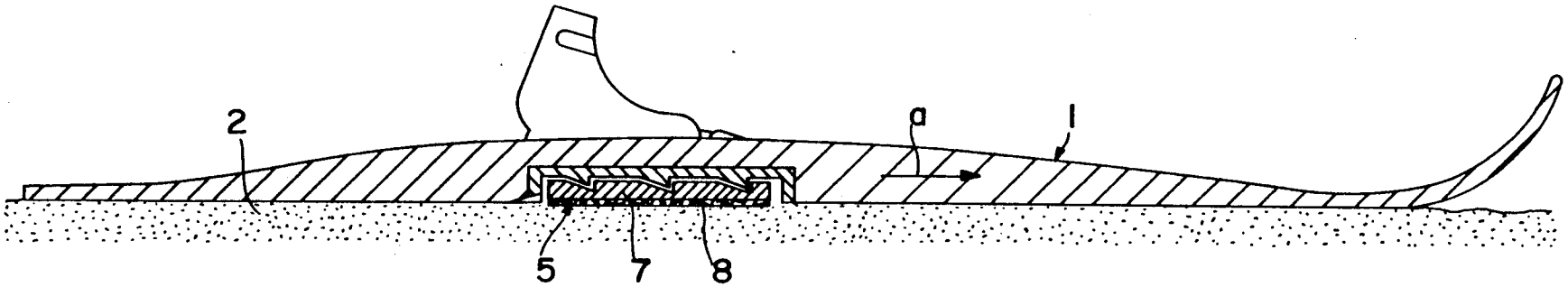
FIG. 2 is a vertical and longitudinal section view of a cross-country ski equipped with a first embodiment of the backward slippage-prevention device according to the invention, the anchoring mechanism being represented in the retracted position during the forward sliding of the ski.
Figure 3:
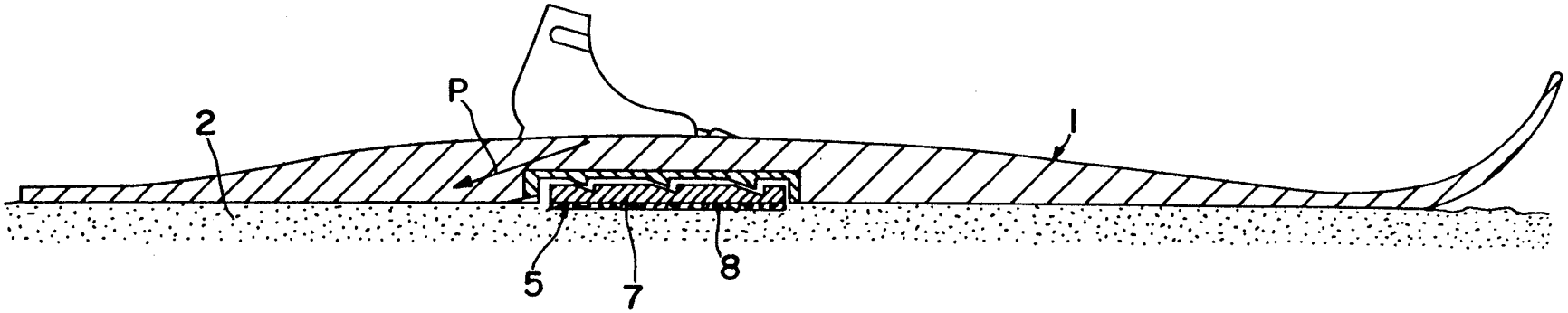
FIG. 3 is a vertical and longitudinal section view similar to that in FIG. 2, the backward slippage-prevention device being shown with its anchoring mechanism in the anchored position in the snow when backward thrust is exerted on the ski.
Figure 4:
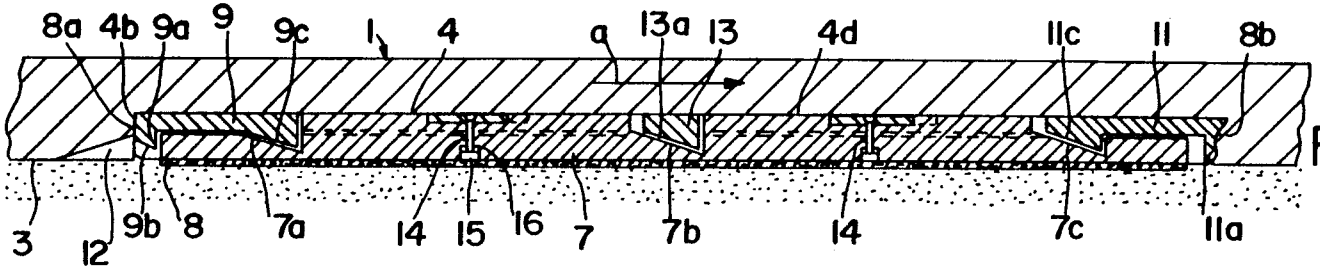
FIG. 4 is a partial vertical and longitudinal section view, on a larger scale, of the area of the cross-country ski where the backward slippage-prevention device shown in FIG. 2 is mounted, the anchoring mechanism being retracted inside its housing.
Figure 5:
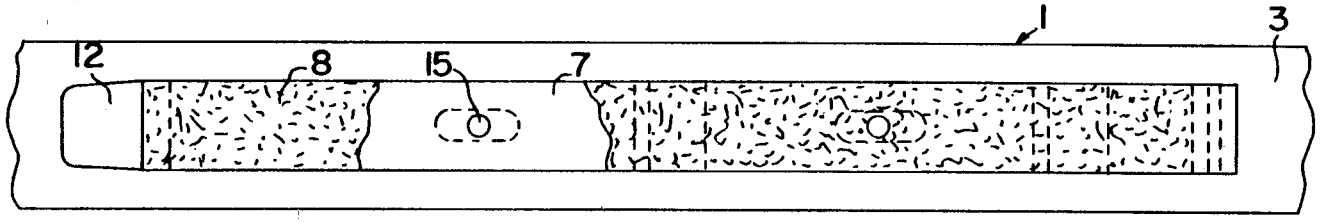
FIG. 5 is a bottom plan view with a partially cutaway view of the backward slippage-prevention device shown in FIG. 4.
Figure 6:
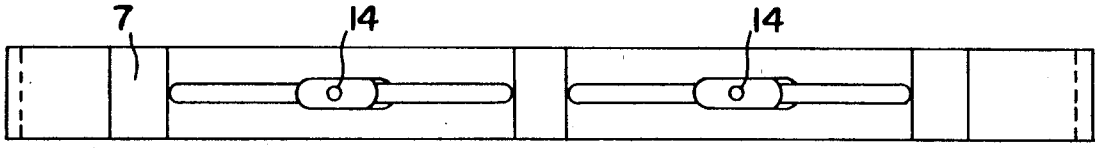
FIG. 6 is a plan view of the movable anchoring device shown in FIG. 4.
Figure 7:
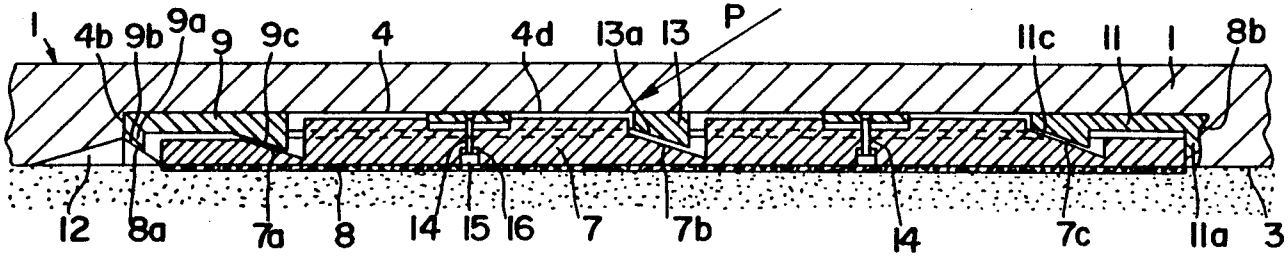
FIG. 7 is a partial vertical and longitudinal section view on a larger scale of the backward slippage-prevention device shown in FIG. 4, i.e., the anchoring mechanism is pushed downward into anchoring position in the snow.

The principle of operation of the backward slippage-prevention device, which has been described with reference to FIGS. 4 to 7 and which is shown mounted on ski 1 in FIGS. 2 and 3, is the same as that explained with respect to the schematic embodiment illustrated in FIGS. 1, 1A, and 1B. When the ski slides forward in the direction of arrow a, the anchoring bar 7 retracts into housing 4 by means of the elastic diaphragm 8, as shown in FIGS. 2 and 4. In this case, the lower horizontal diaphragm 8, made for example of sealskin, extends substantially in the horizontal plane of the sole 3 or slightly set back from this plane. Minimal friction on the snow thus results. On the other hand, when the skier exerts downward and backward thrust P on his ski 1, the backward slippage-prevention device is activated, as shown in FIGS. 3 and 7. The lower inclined surfaces 9*c*, 13*a*, and 11*c* of blocks 9, 13, and 11 then slide rearward on the inclined ramps 7*a*, 7*b*, and 7*c*, respectively, of the anchoring bar 7, thereby causing the downward movement of this anchoring bar 7 parallel to itself. This movement is limited by the vertical stop means 14. As a result, the anchoring bar 7 and the sealskin diaphragm 8 project slightly beneath the plane of the sole 3 of ski 1, as shown in FIGS. 3 and 7, thereby ensuring that the ski will bite and stop in the snow. It should be noted that, in this position, the rear end piece 8*a* of the diaphragm 8 is tightened and pressed against the lower surface 9*b* of the lower rear rib 9*a* of the rear angle block 9.

In this embodiment, the elastic diaphragm 8 acts as a return spring in order to bring the anchoring bar 7 retracted in the housing 4 back into position when rearward thrust P is no longer exerted on the ski 1.

Figure 8:
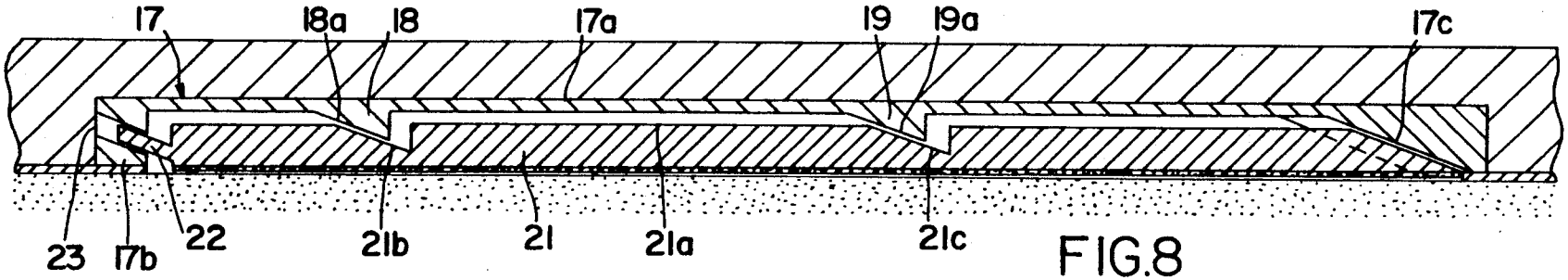
FIG. 8 is a partial vertical and longitudinal section view on a larger scale of the area of the cross-country ski on which a variant of the backward slippage-prevention device is mounted, the anchoring mechanism being withdrawn inside of housing.
Figure 9:
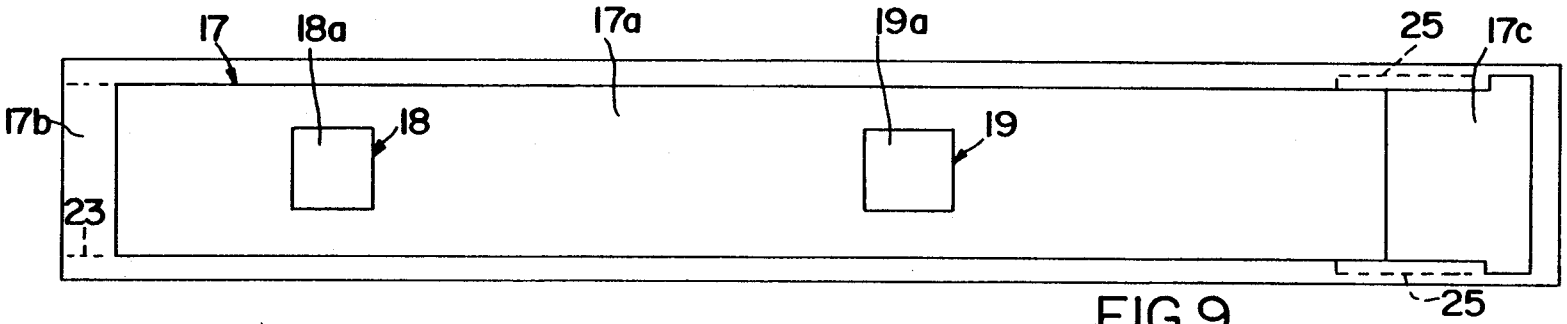
FIG. 9 is a bottom plan view of the box of the backward slippage-prevention device shown in FIG. 8.
Figure 10:
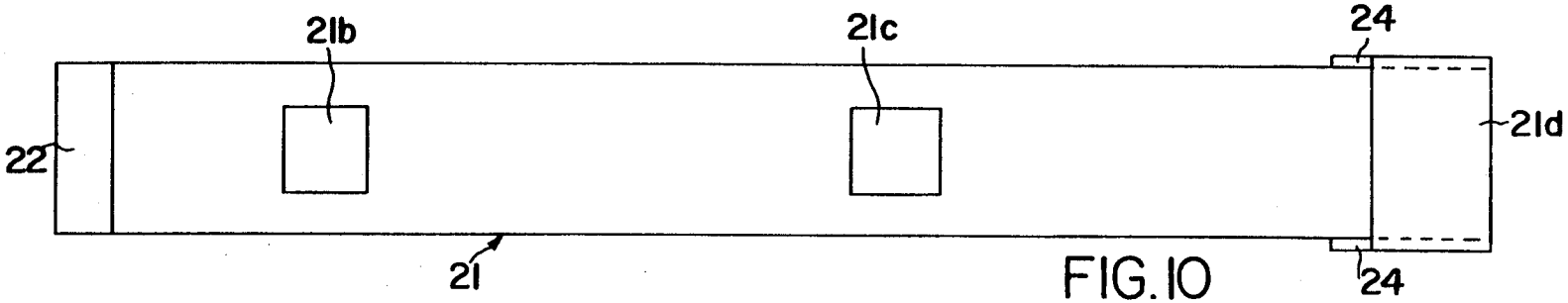
FIG. 10 is a plan view of the anchoring mechanism of the backward slippage-prevention device shown in FIG. 8.

In the embodiment shown in FIGS. 8, 9, and 10, the backward slippage-prevention device according to the invention comprises a parallelepiped-shaped box 17 which is fitted tightly and attached in the housing 4 and whose lower part is open. The box 17 is attached to the inside of the housing 4 by any appropriate means, for example by screwing or adhesive bonding. The upper horizontal wall 17*a* of the box 17 has two pins 18 and 19 separated longitudinally and projecting downward, and which, when viewed in vertical longitudinal section, have the form of identical right-angled triangles. The inclined lower surfaces 18*a*, 19*a* of the pins 18, 19, which form the hypotenuses of the right-angled triangles, slope at the same angle upward and rearward, and they trigger the vertical downward movement of a parallelepiped-shaped longitudinal anchoring bar 21 tightly housed in the box 17. This anchoring bar 21 has a lower surface formed for proper adherence on the snow, for example by means of grooves, the attachment of sealskin, etc. The upper surface 21*a* of the bar also incorporates two recesses, each of which, when viewed in vertical and longitudinal section, has the shape of a right-angled triangle and in which the two pins 18, 19, respectively, are engaged. These recesses are bounded by surfaces 21*b* and 21*c* which slope upward and rearward and connect with the upper surface 21*a* of the bar 21. The inclined surfaces 18*a* and 21*b* are in contact with each other, and the inclined surfaces 19*a* and 21*c* are in contact with each other; all of the surfaces have the same slope.

Furthermore, guide means are provided at the two longitudinal ends of the box 17 and of the anchoring bar 21, to allow the vertical downward movement of the anchoring bar 21 while ensuring impermeability inside of the box 17.

At its posterior end, the anchoring bar 21 is extended by means of a transverse lip 22 which slopes upward and rearward. This lip 22 is engaged in a slot 23 formed in the rear transverse wall 17*b* of the box 17 and which has the same slope as the lip 22 and surfaces 18*a*, 21*b*, 19*a*, and 21*c*.

The front end piece of the anchoring bar 21 has a frontal surface 21*d* which slopes upward and rearward at the same angle of inclination as the rear lip 22, the slot 23, and the inclined contact surfaces 18*a*, 21*b*, 19*a*, and 21*c*. This anterior frontal surface 21*d* of the anchoring bar 21 is in contact with a surface 17*c* of the rear part of the box 17 and having the same angle of inclination. In addition, the anterior rear piece of the anchoring bar 21 has two facing lateral ribs 24 which project outward from the vertical, lateral surfaces of the anchoring bar 21 and which slope at the same angle as the surfaces 21*d* and 17*c*. These inclined ribs 24 are engaged in sloping grooves 25 having the same inclination and which are cut in the rear parts of the interior surfaces of the two vertical side walls of the box 17.

In accordance with the preceding description, it will be seen that the anchoring bar 21 is held in place in the box 17 and guided in relation to the latter, first, at its posterior end as a result of the insertion of the rear inclined lip 22 in the inclined slot 23 of the box 17, and second, at its front end because of its inclined lateral ribs 24 engaged in the sloping grooves 25 of the box 17. These guide means ensure impermeability at the two longitudinal ends of the backward slippage-prevention device, and this impermeability is also ensured along the lateral surfaces of the anchoring bar 21 and of the box because of the tight fitting of the bar 21 into this box.

It should be noted that, in the embodiment shown in FIGS. 8 to 10, the anchoring bar 21 is mounted freely in the box 17 and that it is pressed under pressure against the surface of the snow only when rearward thrust is exerted on the ski. As in the embodiments previously described, this thrust is transformed into downward pressure as a result of the cooperation of inclined surfaces 18*a*, 21*b*, and 19*a*, 21*c*.

As specified above, there are different means which prevent the backward slippage of the ski (scales, wax, sealskin, etc.) corresponding to the different types of snow and whose application underneath the ski is a relatively lengthy and complex process.

Figure 11A:
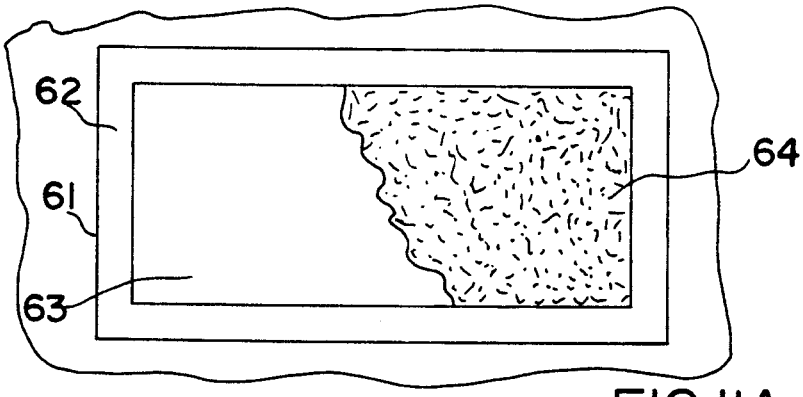
FIGS. 11*a* and 11*b* are longitudinal and bottom plan section views showing an embodiment of the movable backward slippage-prevention device.
Figure 11B:
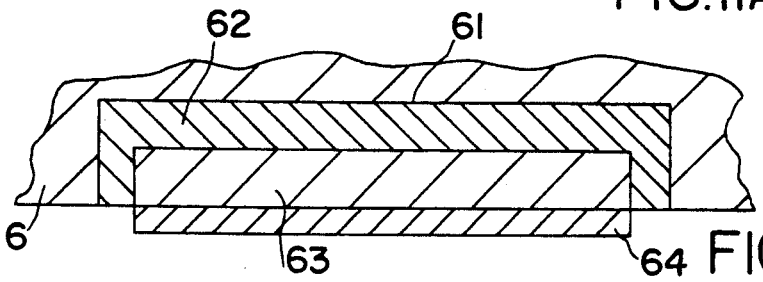

FIGS. 11*a* and 11*b* illustrate an advantageous solution for solving the problem: A movable plate 63 supporting the backward slippage-prevention system 64 may be installed beneath the anchoring means 6 and quickly removed. For this purpose, the lower surface of the anchoring mechanism 6 comprises a recess 61 which serves as a housing for a box 62 attached within the recess 61 using any means such as screwing, adhesive bonding, welding, etc. The movable plate 63 fits into the box 62 and is held in position by friction or a catch mechanism. The backward slippage-prevention device 64 selected for use under the ski is attached to this movable plate. The skier need only have several movable plates 63, to each of which are attached one or several backward slippage-prevention systems, in order to be able to choose at the last moment the most appropriate system for the given conditions. It is also possible that one movable plate 63 has no backward slippage-prevention system over all or a part of its surface.

Figure 12A:
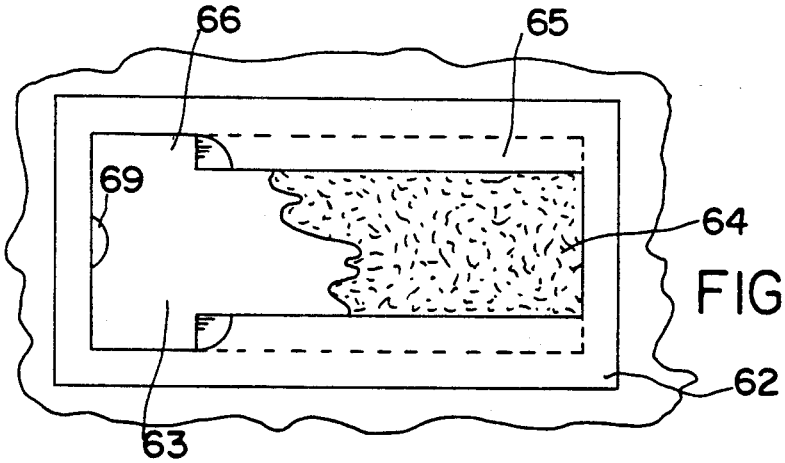
FIGS. 12*a*, 12*b*, and 12*c* are longitudinal, transverse section views and a bottom-plane view of a second embodiment of the backward slippage-prevention device.
Figure 12B:
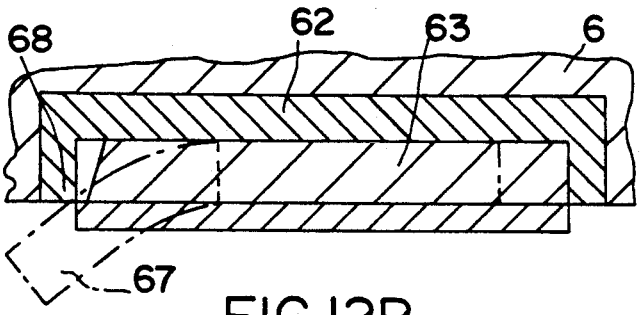
Figure 12C:
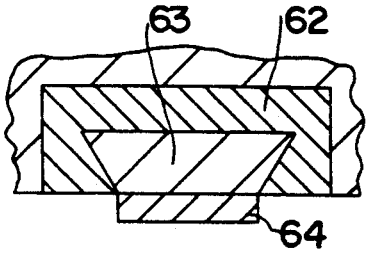

Another embodiment of the box 62 and of the movable plate 63 is shown in FIGS. 12*a*, 12*b*, and 12*c*. The box 62 comprises two grooves 65 in which the movable plate 63 slides. In order to slide the movable plate 63 into position in the box 62, the groove 65 is removed in one end 66 to allow the movable plate 63 to become bent and deformed, as shown by the dotted line 67, in order that the movable plate 63 be allowed to travel above the edge 68 of the box 62 during both its positioning and its removal. A notch 69 provided in the movable plate 63 (or in the edge 68) facilitates the plate-removal operation.

What is claimed is:

1. Backward slippage-prevention device for cross-country skis comprising a movable anchoring mechanism mounted in a housing formed in a ski and having an inside opening into a lower sole of said ski, said housing being longer than said anchoring mechanism to leave longitudinal spacing between said housing and said anchoring mechanism providing play for slight relative longitudinal displacement of said ski and said housing relative to said anchoring mechanism, said housing being located beneath a ski boot support zone of said ski, and comprising at least one upper surface inclined upwardly and rearwardly, said device comprising means adapted to move said anchoring mechanism automatically in said housing from a first, anchoring position in snow when said ski is subjected to backward thrust and in which anchoring position a part of said device projects downwardly beneath said lower sole of said ski, so as to be held immobile in the snow and, when said ski slides forward, a second, retracted position in which a lower part of said anchoring mechanism is withdrawn into said housing, said anchoring mechanism having at least one upper surface inclined upwardly and rearwardly, means being provided to hold said at least one upper, inclined surface of said anchoring mechanism in contact with at least one activating component provided on said upper part of said housing and capable of sliding longitudinally on said at least one upper, inclined surface.

2. Device according to claim 1, comprising elastic means anchored in said housing and in contact with said anchoring mechanism for returning said anchoring mechanism to said inside of said housing when rearward thrust is no longer exerted on said ski.

3. Device according to claim 1, comprising means for guiding and holding in position said anchoring mechanism during movement of said anchoring mechanism relative to said inside of said housing.

4. Device according to claim 1, comprising a parallelpiped-shaped, longitudinally elongated anchoring bar having a lower horizontal surface in contact with a flexible, elastic diaphragm comprising a snow-adherent lower surface, extending beneath an entire length of said anchoring bar and comprising two end pieces anchored in said housing, said anchoring bar being retracted into said housing by action of said diaphragm when said ski slides forward.

5. Device according to claim 4, wherein end pieces of said diaphragm are wedged between a rear frontal surface and anterior frontal surface of said housing and front and rear angle blocks attached respectively in two upper angles of the housing.

6. Device according to claim 5, wherein said rear angle block set against said rear frontal surface of said housing, in a rear upper angle of said housing, comprises a lower transverse rib terminating in an upwardly and rearwardly sloping lower surface.

7. Device according to claim 6, wherein said lower inclined surface of said rib of said rear angle block is located above a plane of said sole of said ski and opposite a recess formed in a central part of said sole of said ski and whose upper upwardly and rearwardly sloping surface extends between said sole and said rear frontal surface of said housing.

8. Device according to claim 5, wherein said rear angle block has a front part with a downward projecting surface which slopes upwardly and rearwardly and which constitutes a ramp cooperating with a similarly sloping upper surface of said anchoring bar, said sloping upper surface forming the lower part of an upper recess of said longitudinal bar, in which said anterior rear part of said rear angle block is inserted.

9. Device according to claim 5, comprising an intermediate block attached to said upper horizontal surface of said housing and ending in a lower inclined surface which is in contact with an inclined surface forming a ramp which delimits a recess formed in a substantially median part of said upper surface of said anchoring bar.

10. Device according to claim 5, wherein said front angle block comprises a lower, front rib which is pressed against an anterior frontal surface of said housing, in order to clamp and hold in position a front end piece of said diaphragm, and of said front angle block comprises a downward projecting inclined surface which engages in a corresponding recess provided in a front part of the upper surface of said anchoring bar, said recess being bounded by one inclined surface having the same slope.

11. Device according to claim 5, comprising means for limiting downward travel of said anchoring bar, said means comprising vertical rods passing through holes drilled in said anchoring bar, upper ends of said rods being attached to said upper surface of said housing and lower ends of said rods being unitary with head set in recesses provided in said lower horizontal surface of said anchoring bar, a height of said recesses begin greater than a thickness of said heads.

12. Device according to claim 9, wherein said rear angle block, an intermediate block and said front angle block are comprised of separate blocks individually attached to said upper surface of said housing.

* * * * *